US011377889B2

(12) United States Patent
Zetti

(10) Patent No.: US 11,377,889 B2
(45) Date of Patent: Jul. 5, 2022

(54) HINGE WITH DAMPED CLOSING

(71) Applicant: D.G.N. S.R.L., Modena (IT)

(72) Inventor: Daniele Zetti, Modena (IT)

(73) Assignee: D.G.N. S.R.L., Modena (IT)

( * ) Notice: Subject to any disclaimer, the term of this patent is extended or adjusted under 35 U.S.C. 154(b) by 0 days.

(21) Appl. No.: 16/877,883

(22) Filed: May 19, 2020

(65) Prior Publication Data

US 2020/0370349 A1 Nov. 26, 2020

(30) Foreign Application Priority Data

May 23, 2019 (IT) ..... 102019000007146

(51) Int. Cl.
*E05D 3/16* (2006.01)

(52) U.S. Cl.
CPC ..... *E05D 3/16* (2013.01); *E05Y 2900/20* (2013.01)

(58) Field of Classification Search
CPC ..... E05D 3/16; E05D 2003/163; E05D 2003/166
See application file for complete search history.

(56) References Cited

U.S. PATENT DOCUMENTS 5,035,026 A * 7/1991 Carlo ..... E05D 11/1021 16/288
6,243,918 B1 * 6/2001 Zetti ..... E05D 3/16 16/293
6,374,459 B1 * 4/2002 Zetti ..... E05D 3/16 16/286
6,402,270 B1 * 6/2002 Frank ..... A47F 3/005 16/366
6,568,035 B2 * 5/2003 Zetti ..... E05D 3/16 16/286
7,100,241 B2 * 9/2006 Zetti ..... E05D 3/16 16/283
7,197,790 B1 * 4/2007 Edmondson ..... E05D 3/16 16/286

(Continued)

FOREIGN PATENT DOCUMENTS

EP 2909406 A1 8/2015
EP 2947246 A1 11/2015

(Continued)

OTHER PUBLICATIONS

Italian Search Report dated Jan. 30, 2020 issued in IT 201900007146, with partial translation.

*Primary Examiner* — Jeffrey O'Brien
(74) *Attorney, Agent, or Firm* — Scully, Scott, Murphy & Presser, P.C.

(57) ABSTRACT

A hinge with damped closing, comprising a first four-bar linkage, which comprises a coupling element which can be associated with a fixed element, a first portion of a first lever and a third lever which are associated in an articulated manner with the coupling element and a first portion of a second lever that is interposed between the preceding ones and is articulated thereto; the hinge further comprises a second four-bar linkage and at least one damping element that has the first end associated in an articulated manner with at least one lever of the first four-bar linkage and the second end associated in an articulated manner with at least one lever of the second four-bar linkage.

5 Claims, 9 Drawing Sheets

(56) References Cited

U.S. PATENT DOCUMENTS 7,543,356 B2 * 6/2009 Zetti ..... E05D 3/16 16/238
7,591,046 B2 * 9/2009 Zetti ..... E05D 3/16 16/286
7,797,796 B2 * 9/2010 Migli ..... E05D 15/46 16/366
7,861,376 B2 * 1/2011 Fitz ..... E05F 5/006 16/286
7,987,558 B2 * 8/2011 Beckmann ..... E05D 11/0054 16/366
8,082,629 B2 * 12/2011 Migli ..... E05F 1/1091 16/366
8,132,294 B2 * 3/2012 Spreafico ..... E05D 3/16 16/370
8,225,459 B2 * 7/2012 Waltemate ..... E05D 3/16 16/366
8,656,559 B2 * 2/2014 Hung ..... E05D 3/16 16/369
9,169,681 B2 * 10/2015 Cooper ..... E05F 5/006
9,441,407 B2 * 9/2016 Zetti ..... E05F 3/20
9,617,773 B2 * 4/2017 Cooper ..... E05D 3/14
9,777,525 B2 * 10/2017 Salice ..... E05F 3/10
9,803,405 B2 * 10/2017 Zetti ..... E05D 3/16
10,041,283 B2 * 8/2018 Zetti ..... E05D 3/16
10,221,597 B2 * 3/2019 Hammerer ..... E05F 5/006
2005/0188505 A1 * 9/2005 Bennett ..... E05D 3/16 16/366
2005/0241105 A1 * 11/2005 Wiley ..... E05D 3/16 16/266
2006/0090296 A1 * 5/2006 Zetti ..... E05F 1/1253 16/302
2007/0251058 A1 * 11/2007 Fitz ..... E05D 3/16 16/287
2009/0241288 A1 * 10/2009 Zetti ..... E05D 11/1064 16/236
2017/0241176 A1 * 8/2017 Zetti ..... E05F 1/1261
2017/0306680 A1 * 10/2017 Zetti ..... E05F 5/10
2018/0106088 A1 * 4/2018 Zetti ..... E05D 11/105

FOREIGN PATENT DOCUMENTS

EP 3115531 A1 1/2017
EP 3309335 A1 4/2018
EP 3312372 A1 4/2018
WO WO 2006/053364 A1 5/2006
WO WO 2014/061041 A1 4/2014

* cited by examiner

HINGE WITH DAMPED CLOSING

The present invention relates to a hinge with damped closing.

With particular but not exclusive reference to the field of the production of furniture, particularly for furnishing caravans, campers, boats or cabins of vehicles, hinges for the articulation of compartment closure doors, such as those usually used in wall-mounted units and the like, are known. These hinges must allow the movement of the door between a closed configuration and an open configuration, in which it has different arrangements. In the movement between the open and closed configurations, the door changes its arrangement, remaining at right angles to a vertical plane.

These hinges are constituted essentially by a first four-bar linkage and by a second four-bar linkage, which are provided with a first lever and a second lever in common and have as a base element respectively an element for coupling to a fixed component of a structure of a piece of furniture that forms a compartment and an element for fixing to a movable component for the closure of said compartment, such as a door or the like. In the movement of the hinge between the open and closed configurations, the fixing element changes its relative position with respect to the coupling element.

In order to support the weight of the door in the open configuration and to ensure that the closed configuration is maintained, these hinges are usually provided with elastic compression means which cooperate with the elements of the first and/or second four-bar linkage.

Moreover, in order to damp the transition of the hinge between the open configuration and the closed configuration, avoiding impacts of the door against the structure of the piece of furniture, it is known to provide damping elements, such as small pistons, which act between the elements of the first or second four-bar linkage.

For example, patent application EP 3309335 A1 describes a hinge of the type described above, which incorporates a damping element that acts between two consecutive levers of the second four-bar linkage.

Patent application EP 3115531 A1 also provides for the interposition of the damping element between consecutive elements of the first or second four-bar linkage.

As an alternative, patent applications EP 3312372 A1 and EP 2909406 A1 in the name of the same Applicant teach to provide a damping element which acts between the fixing element and a lever of the second four-bar linkage that is contiguous thereto, or from patent application EP 2947246 A1, again in the name of the same Applicant, it is known to interpose the damping element between the coupling element and the lever that is opposite thereto of the first four-bar linkage.

However, all these hinge versions with damped closing of the known type are not free from drawbacks, which include the fact that the presence of the damping element entails an increase in bulk in the region for connection to the structure of the piece of furniture or to the closure door, complicating its installation and making the visual impact of the hinge less pleasant when the door stays open.

The aim of the present invention is to eliminate the drawbacks described above of the background art by providing a hinge with damped closing which has a smaller bulk, being easier to install and aesthetically less impactful in the open configuration.

Within this aim, an object of the present invention is to have a structure that is simple, relatively easy to provide in practice, safe in use, effective in operation, and of relatively low cost.

This aim and these and other objects that will become more apparent hereinafter are all achieved by the present hinge with damped closing, comprising a first four-bar linkage, which comprises a coupling element which can be associated with a fixed element, a first portion of a first lever and a third lever which are associated in an articulated manner with said coupling element and a first portion of a second lever that is interposed between the preceding ones and is articulated thereto; a second four-bar linkage, which comprises a fixing element which can be associated with an element which can move with respect to said fixed element, a second portion of said second lever and a fourth lever which are associated in an articulated manner with said fixing element and a second portion of said first lever that is interposed between the preceding ones and is articulated thereto; the hinge being adapted to assume alternately an open configuration and a closed configuration, in which said coupling element and said fixing element have different relative positions, said levers rotating about respective articulation pivots which are substantially horizontal in use during the movement between the open and closed configurations; the hinge being further provided with at least one damping element which acts for at least one portion of the transition from the open configuration to the closed configuration and is provided with a first end and with a second end which can move alternately toward and away from each other between an extended configuration and a retracted configuration, characterized in that said at least one damping element has said first end associated in an articulated manner with at least one lever of said first four-bar linkage and said second end associated in an articulated manner with at least one lever of said second four-bar linkage.

Further characteristics and advantages of the present invention will become better apparent from the detailed description of three preferred but not exclusive embodiments of a hinge with damped closure, illustrated by way of non-limiting example in the accompanying drawings, wherein.

Figure 1:
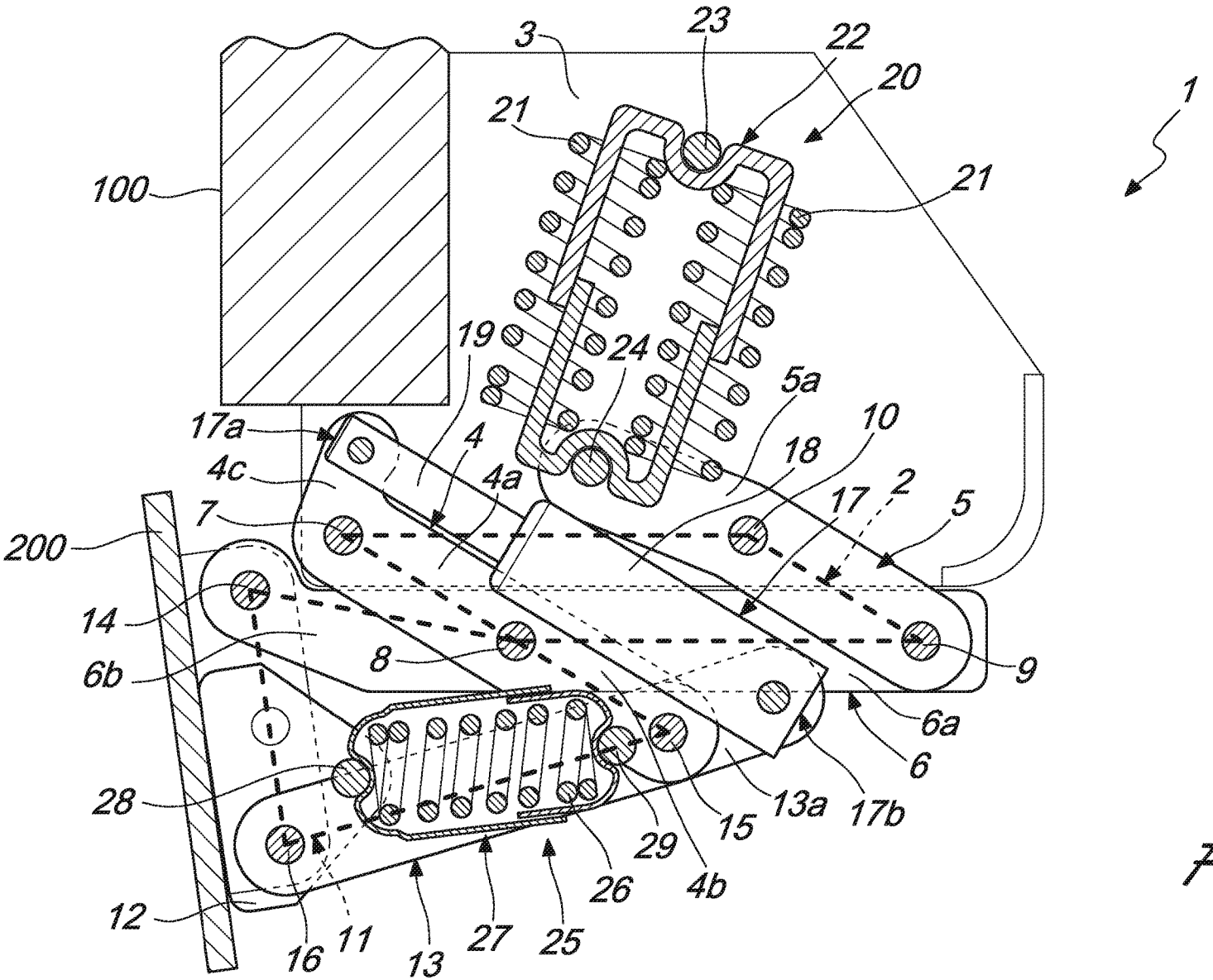
FIGS. 1-3 are partially sectional views, taken along a central vertical plane, of a first embodiment of a hinge with damped closure, according to the invention, respectively in the closed configuration, in an intermediate configuration and in the open configuration.

With reference to the figures cited above, the reference numeral 1 generally designates a hinge with damped closure.

The hinge 1 comprises a first four-bar linkage 2, which comprises a coupling element 3 that can be associated with a fixed element 100, a first portion 4*a* of a first lever 4 and a third lever 5 which are associated in an articulated manner with the coupling element 3, and a first portion 6*a* of a second lever 6 that is interposed between the preceding ones and is articulated thereto.

The coupling element 3 can be variously shaped according to the requirements of the specific application.

The fixed element 100 can be constituted for example by a wall of a piece of furniture that forms an accommodation compartment.

In the figures, the following articulation pivots are numbered as follows: articulation pivot 7 interposed between the coupling element 3 and the first portion 4*a* of the first lever 4; articulation pivot 8 interposed between the first lever 4 and the second lever 6; articulation pivot 9 interposed between the first portion 6*a* of the second lever 6 and the third lever 5; articulation pivot 10 interposed between the third lever 5 and the coupling element 3.

In normal conditions of use of the hinge, the rotation axes formed by the articulation pivots 7, 8, 9 and 10 have a substantially horizontal arrangement, within ordinary machining and assembly tolerances.

Furthermore, the hinge 1 comprises a second four-bar linkage 11, which comprises a fixing element 12 that can be associated with an element 200 that is movable with respect to the fixed element 100, a second portion 6*b* of the second lever 6 and a fourth lever 13, which are associated in an articulated manner with the fixing element 12, and a second portion 4*b* of the first lever 4 that is interposed between the preceding ones and is articulated thereto.

The fixing element 12 can be variously shaped according to the requirements of the specific application.

The movable element 200 can be constituted for example by a door or a hatch for closing said accommodation compartment.

In the figures, the following articulation pivots are numbered as follows: articulation pivot 14 interposed between the fixing element 12 and the second portion 6*b* of the second lever 6; articulation pivot 15 interposed between the second portion 4*b* of the first lever 4 and the fourth lever 13; articulation pivot 16 interposed between the fourth lever 13 and the fixing element 12.

The first and second portions 4*a* and 4*b* of the first lever are substantially mutually aligned. The first and second portions 6*a* and 6*b* of the second lever 6 are substantially mutually aligned.

The articulation pivot 8 interposed between the first and second levers 4 and 6 is common to the two four-bar linkages 2 and 11.

In normal conditions of use of the hinge, the rotation axes defined by the articulation pivots 14, 15 and 16 have a substantially horizontal arrangement, within ordinary machining and assembly tolerances.

Figure 5:
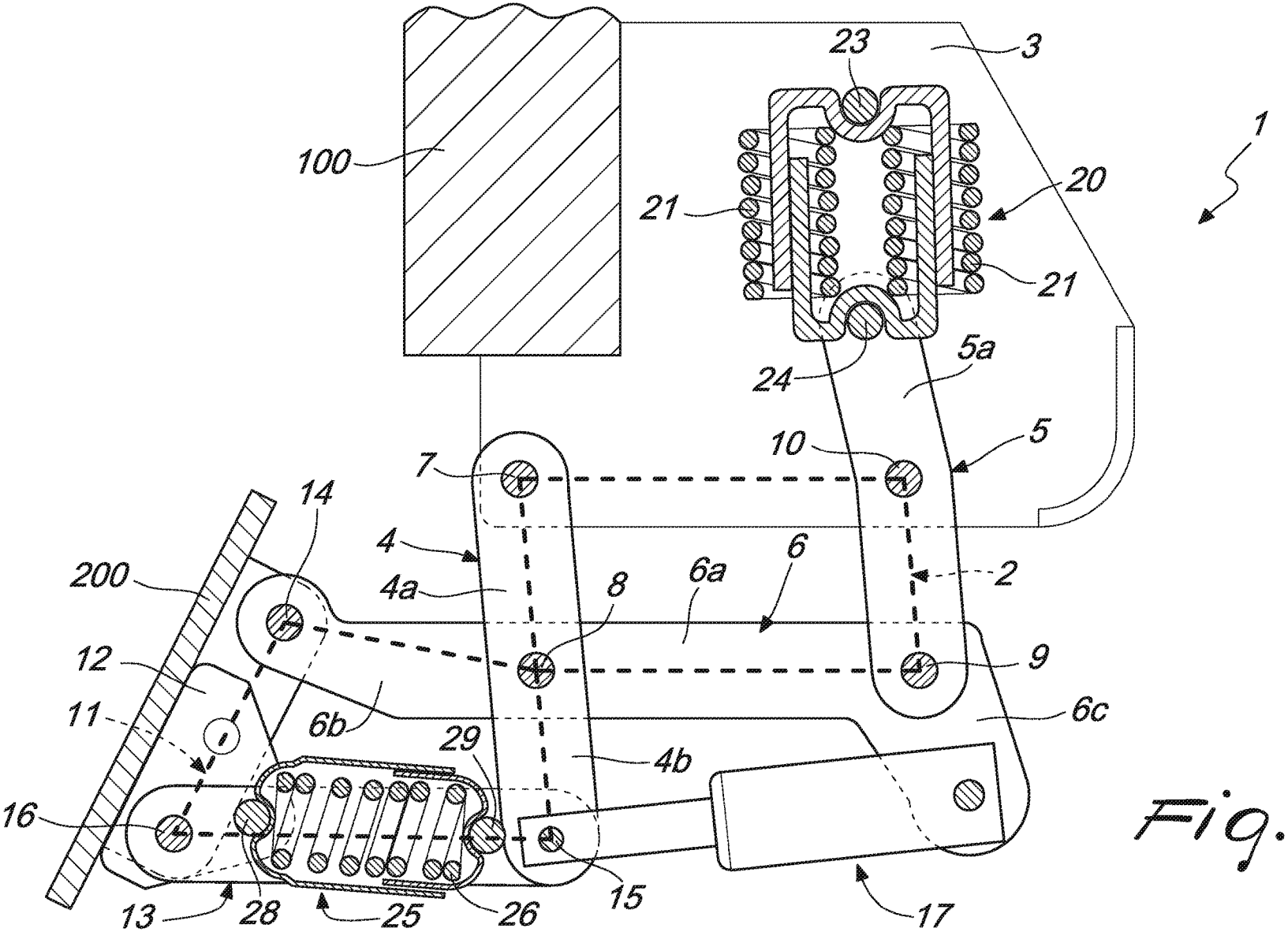
Figure 6:
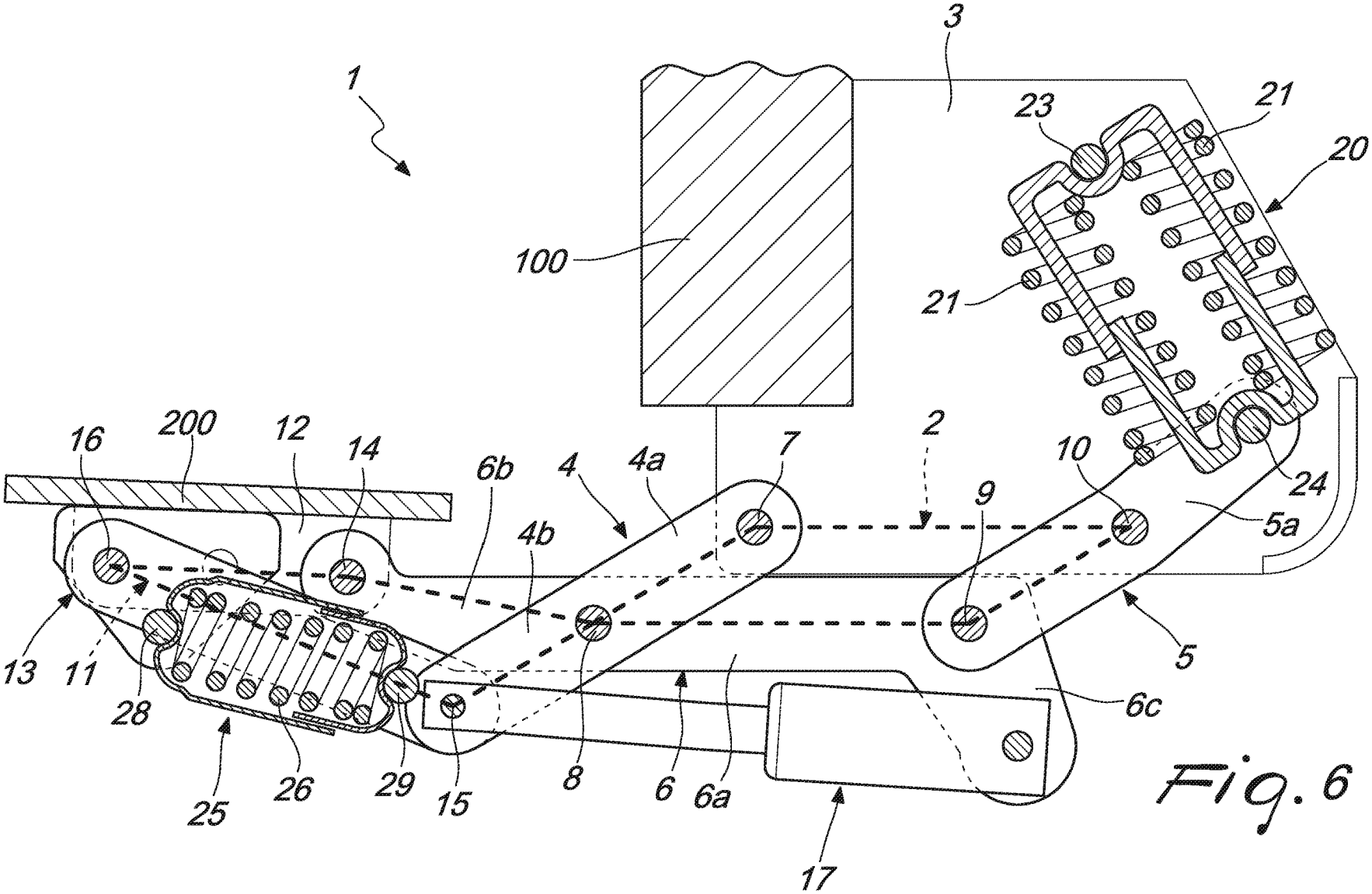
Figure 8:
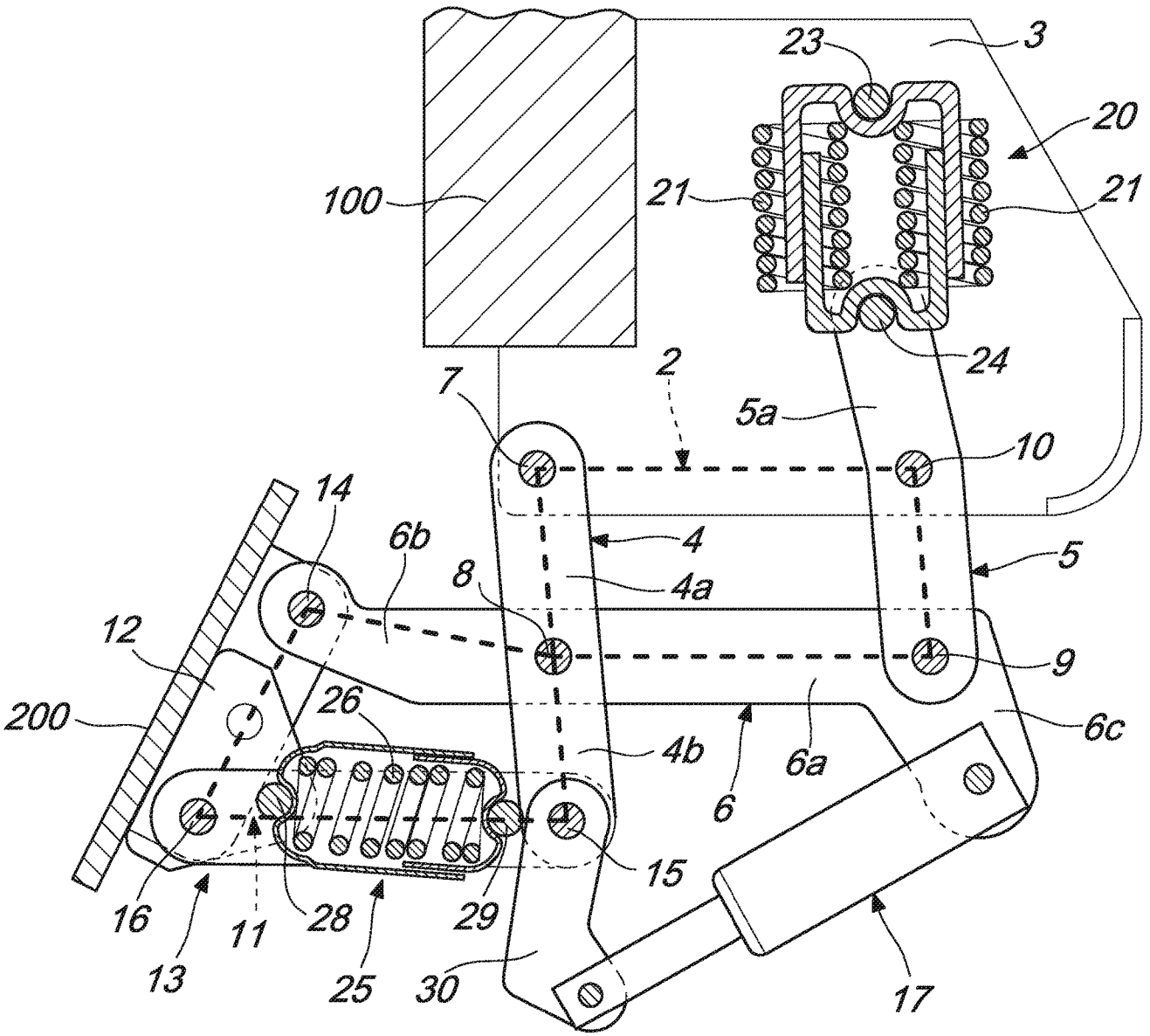
Figure 9:
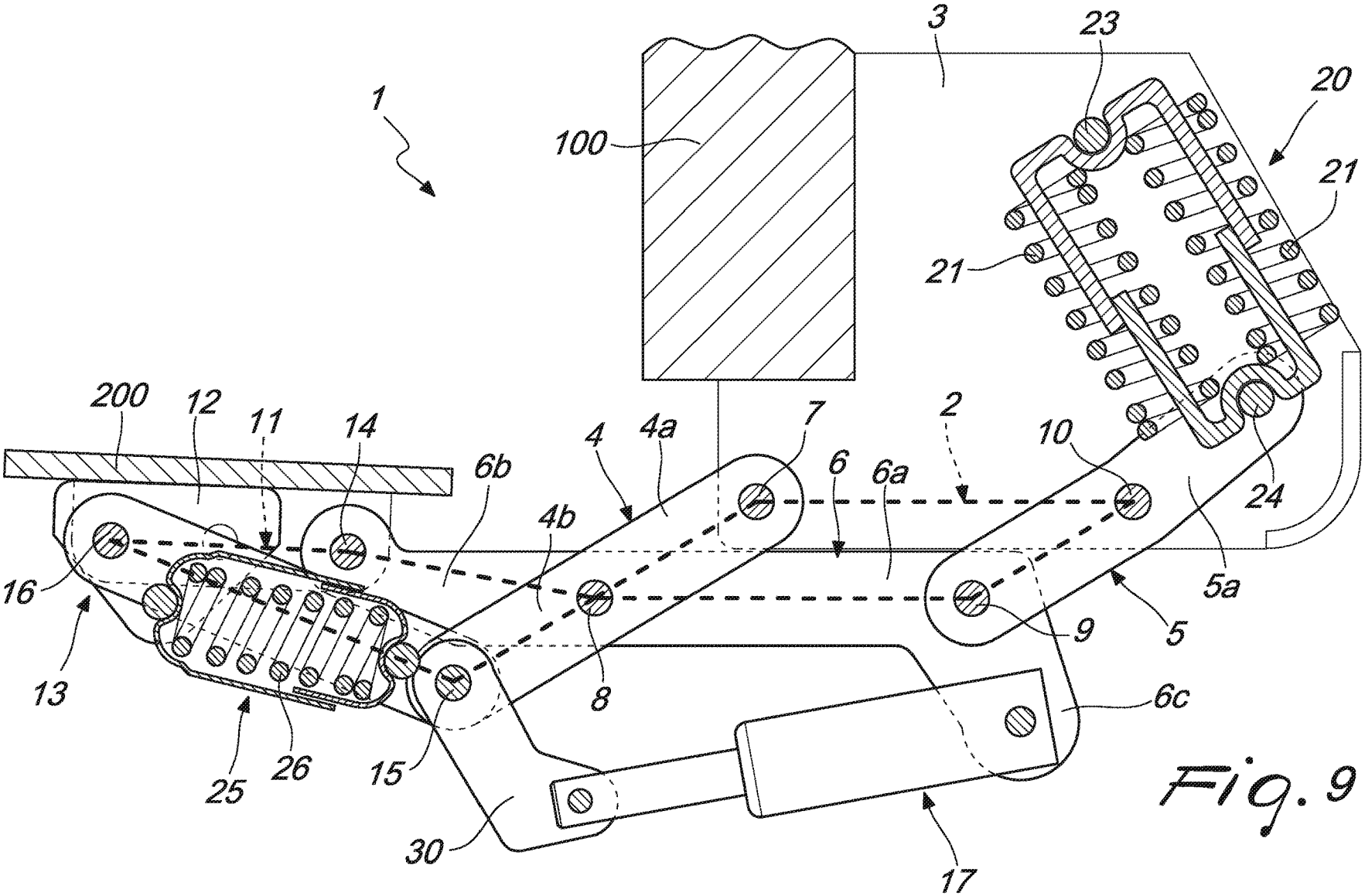

The hinge 1 is adapted to assume alternatively an open configuration (FIGS. 3, 6 and 9) and a closed configuration (FIGS. 1, 4 and 7), passing through a plurality of configurations that are intermediate between the preceding ones (FIGS. 2, 5 and 8), in which the coupling and fixing elements 3 and 12 have different relative positions.

Furthermore, the hinge 1 comprises at least one damping element 17 that acts at least in the end portion of the transition from the open configuration to the closed configuration. The damping element 17 is provided with a first end 17*a* and with a second end 17*b*, which are mutually opposite and can move alternately toward and away from each other between an extended configuration, in which they are at a maximum distance, and a retracted configuration, in which they are at a minimum distance. These maximum and minimum distances can vary according to the size of the damping element 17.

The damping element 17 is essentially constituted by a fluid-operated cylinder, which comprises a jacket 18 inside which a piston, not visible in the figures and integral with a protruding stem 19, can move. The operating chambers formed inside the jacket 18 on opposite sides of the piston mutually communicate so as to allow the recirculation of the working fluid with which the jacket is filled.

Preferably, the hinge 1 is provided with a damping element 17 which acts at a central plane that is substantially perpendicular to the articulation pivots 7-10, 14-16 and is vertical in the conditions of use of the hinge.

The damping element has the first end 17*a* associated in an articulated manner with at least one lever 4, 5 or 6 of the first four-bar linkage 2 and the second end 17*b* associated in an articulated manner with at least one lever 4, 6 or 13 of the second four-bar linkage 11.

Furthermore, the hinge 1 can have first elastic compression means 20 associated with the first four-bar linkage 2. Preferably, the first elastic means 20 are interposed between the third lever 5 and the coupling element 3.

More precisely, in the illustrated embodiments, the first elastic means 20 comprise a pair of helical elastic compression springs 21 which are arranged in a parallel configuration and are supported by a telescopic structure 22. The telescopic structure 22 is pivoted about a first pivot 23 which is associated with the coupling element 3 and about a second pivot 24 which is associated with an extension 5*a* of the third lever 5 that protrudes beyond the articulation pivot 10 toward said coupling element.

However, it is not excluded that the first elastic means 20 might be shaped differently and might be constituted for example by a single, optionally encapsulated helical spring, or that the hinge 1 might not have one.

The hinge 1 may furthermore have second elastic compression means 25 associated with the second four-bar linkage 11. Preferably, the second elastic means 25 are interposed between the fourth lever 13 and the fixing element 12.

More precisely, in the illustrated embodiments, the second elastic means 25 comprise a single helical spring 26 that is encapsulated within a telescopic casing 27. The telescopic casing 27 is pivoted about a third pivot 28 associated with the fixing element 12 and a fourth pivot 29 associated with the fourth lever 13 between the articulation pivots 15 and 16, proximate to the latter.

It is not excluded, however, that the second elastic means 25 might be shaped differently and might be constituted for example by two or more springs in a parallel arrangement, or that the hinge 1 might not have one.

The presence of the first and/or second elastic means 20 and 25 facilitates the retention of the hinge 1 both in the open configuration, supporting the weight of the movable element 200, and in the closed configuration, avoiding accidental openings of said movable element.

Figure 2:
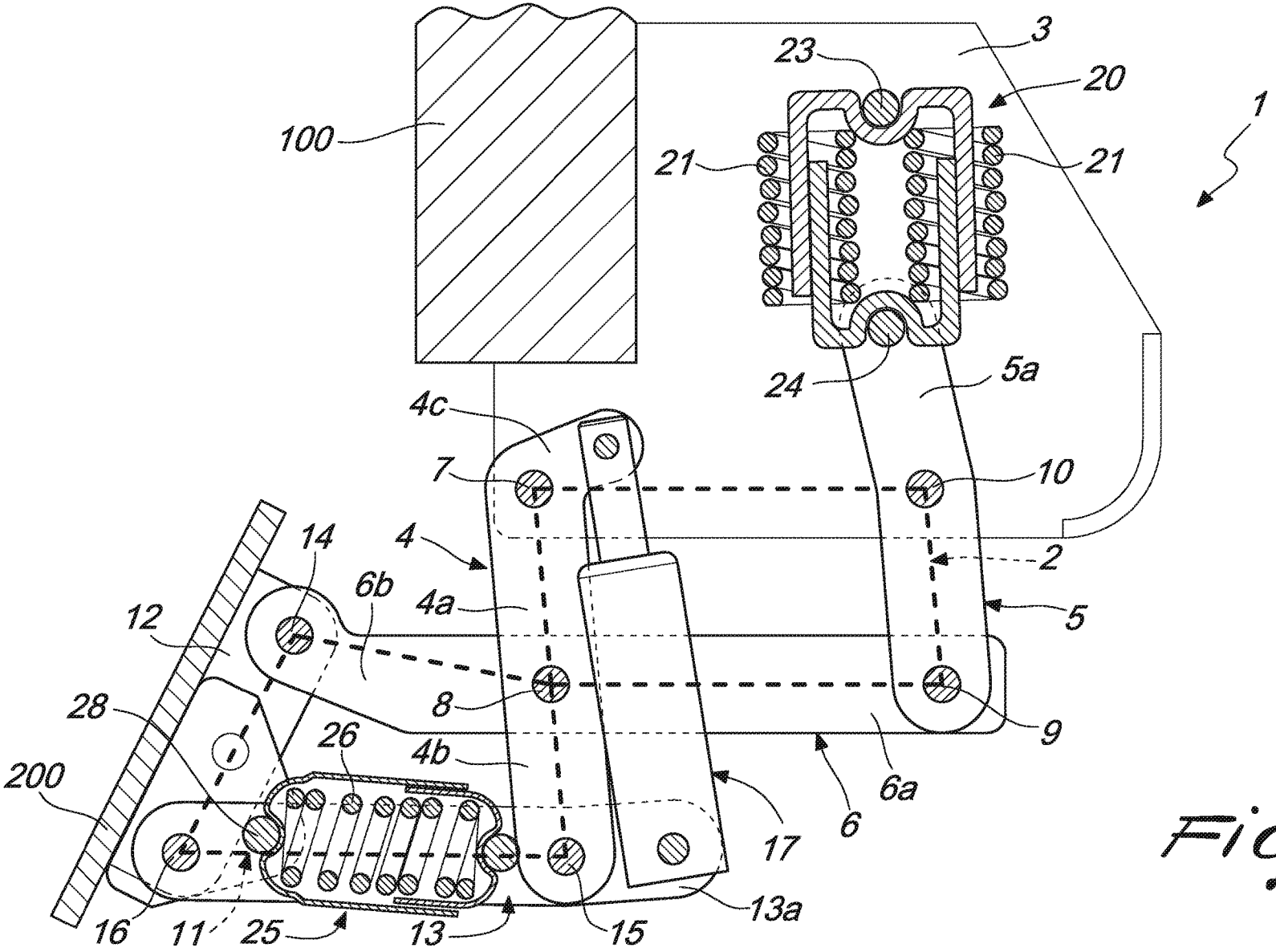
Figure 3:
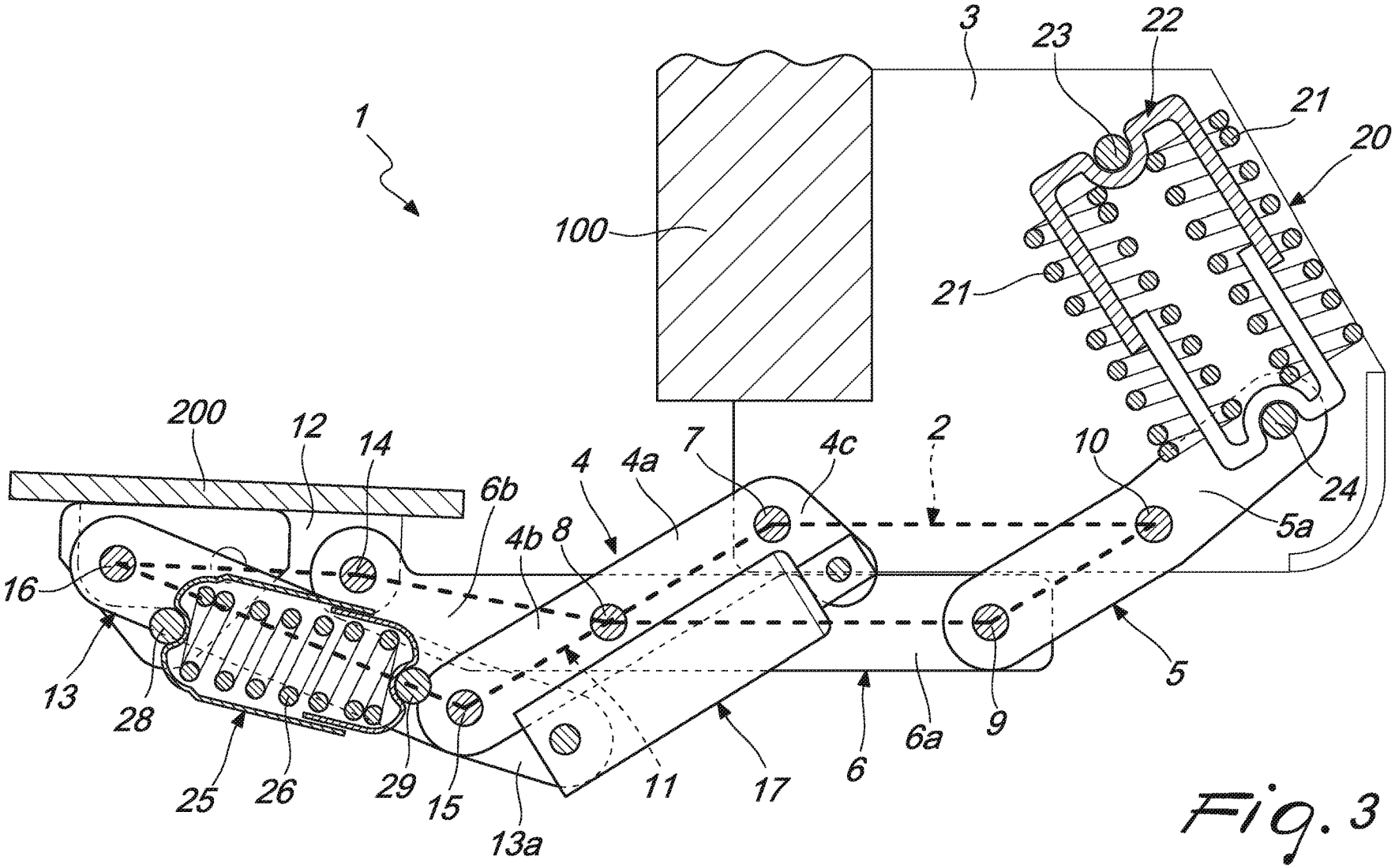

In a first embodiment (FIGS. 1-3), the damping element 17 is adapted to assume the extended configuration at the closed configuration (FIG. 1) and the retracted configuration at the open configuration (FIG. 3), modifying with continuity the relative position of the jacket 18 and of the stem 19 in the transition between these configurations and passing through a plurality of intermediate configurations, one of which is shown by way of example in FIG. 2.

In this first embodiment, the first end 17*a* coincides with the free end of the stem 19 and the second end 17*b* coincides with the bottom of the jacket 18.

In greater detail, the damping element 17 has the first end 17*a* associated in an articulated manner with a tab 4*c* that is adjacent to the first portion 4*a* of the first lever 4, which protrudes toward the coupling element 3 transversely to the extension of said first lever at the articulation pivot 7 and the second end 17*b* associated in an articulated manner with an extension 13*a* of the fourth lever 13 that protrudes beyond the articulation pivot 15.

Figure 4:
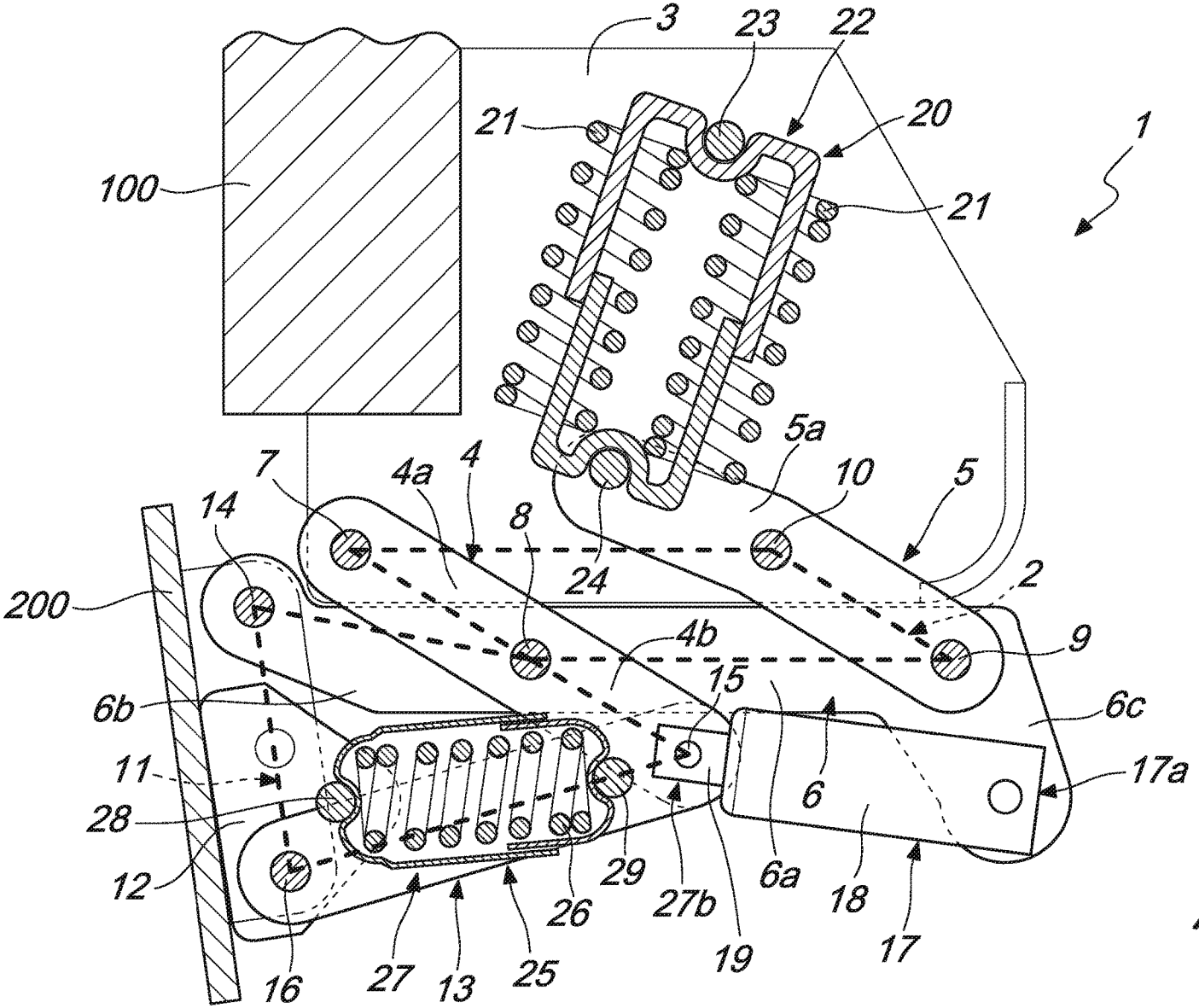
FIGS. 4-6 are partially sectional views, taken along a central vertical plane, of a second embodiment of the hinge according to the invention, respectively in the closed configuration, in an intermediate configuration, and in the open configuration.

In a second embodiment (FIGS. 4-6), the damping element 17 is adapted to assume the retracted configuration at the closed configuration (FIG. 4) and the extended configuration at the open configuration (FIG. 6), modifying with continuity the relative position of the jacket 18 and of the stem 19 in the transition between these configurations and passing through a plurality of intermediate configurations, one of which is shown by way of example in FIG. 4.

In this second embodiment, the first end 17*a* coincides with the bottom of the jacket 18 and the second end 17*b* coincides with the free end of the stem 19.

Preferably, the damping element 17 may have the stem 19 of the telescopic type to allow an adequate modification of the relative distance between the ends 17*a* and 17*b* in the transition between the open and closed configurations.

In greater detail, the damping element 17 has the first end 17*a* associated in an articulated manner with a tab 6*c* that is adjacent to the first portion 6*a* of the second lever 6 that protrudes on the opposite side of the coupling element 3 at the articulation pivot 9 and the second end 17*b* associated in an articulated manner with the articulation pivot 15.

In a third embodiment (FIGS. 7-9), which constitutes a variation of the preceding one, the damping element 17 is adapted to maintain the extended configuration during a first part of the transition from the open configuration to the closed configuration.

In greater detail, the damping element 17 has, as in the preceding version, the first end 17*a* associated in an articulated manner with the tab 6*c* of the second lever 6, while the second end 17*b* is associated in an articulated manner with a contoured arm 30, which is associated in an articulated manner about the articulation pivot 15 and is arranged with the tip directed toward the tab 6*c*.

Figure 7:
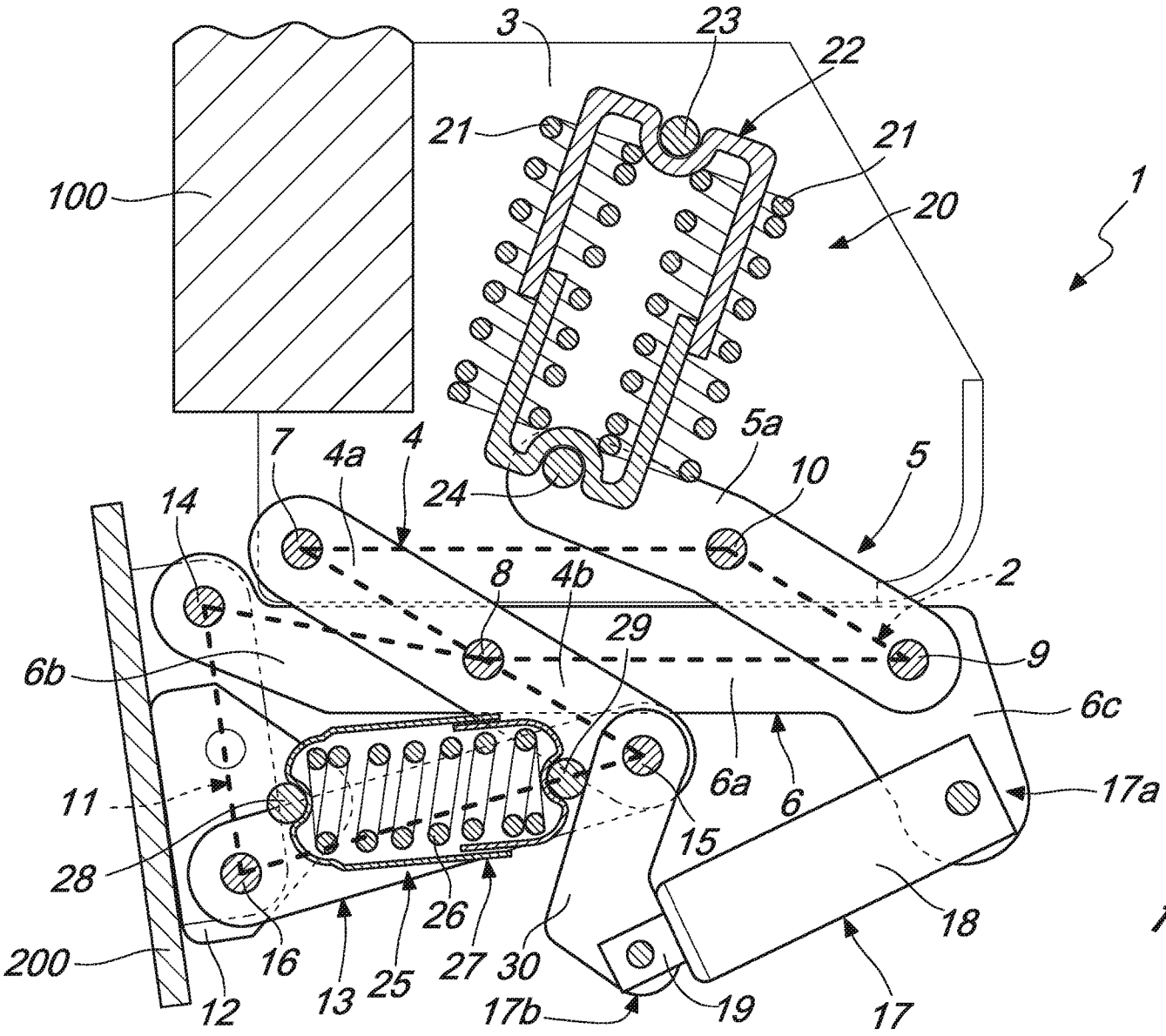
FIGS. 7-9 are partially sectional views, taken along a central vertical plane, of a third embodiment of the hinge according to the invention, respectively in the closed configuration, in an intermediate configuration, and in the open configuration.

In this manner, the arm 30 is free to rotate about the articulation pivot 15 with respect to the levers 4 and 13 through a certain angle that corresponds to the initial part of the transition from the open configuration to the closed configuration, keeping the damping element 17 in the extended configuration (FIGS. 8 and 9), until it abuts against the second elastic means 25, which prevent its further relative rotation with respect to the fourth lever 13 in the final part of the transition from the open configuration to the closed configuration, with consequent gradual return of the stem 19 inside the jacket 18 until it reaches the retracted configuration of the damping element 17 at the closed configuration (FIG. 7).

In practice it has been found that the described invention achieves the proposed aim and objects, and in particular the fact is stressed that the hinge according to the invention allows to obtain an effective damping effect in this closure step without increasing its bulk and without penalizing the visual impact thereof in the open configuration.

The invention thus conceived is susceptible of numerous modifications and variations, all of which are within the scope of the appended claims.

All the details may furthermore be replaced with other technically equivalent elements.

In practice, the materials used, as well as the contingent shapes and dimensions, may be any according to the requirements without thereby abandoning the protective scope of the claims that follow.

The disclosures in Italian Patent Application No. 102019000007146 from which this application claims priority are incorporated herein by reference.

What is claimed is:

1. A hinge with damped closing, comprising a first four-bar linkage, which comprises a coupling element which is configured to be directly connected to a fixed element, a first portion of a first lever and a third lever that are directly connected in an articulated manner to said coupling element and a first portion of a second lever that is interposed between the first portion of the first lever and the third lever and is articulated thereto, a second four-bar linkage, which comprises a fixing element which is configured to be directly connected to an element which is configured to move with respect to said fixed element, a second portion of said second lever and a fourth lever that are directly connected in an articulated manner to said fixing element and a second portion of said first lever that is interposed between the second lever and the fourth lever and is articulated thereto, the hinge being adapted to assume alternately an open configuration and a closed configuration, in which said coupling element and said fixing element have different relative positions, said levers rotating about respective articulation pivots which are substantially horizontal in use during a movement between open and closed configurations, the hinge being further provided with at least one damping element which acts for at least one portion of a transition from the open configuration to the closed configuration and is provided with a first end and with a second end which is configured to move alternately toward and away from each other between an extended configuration and a retracted configuration, wherein said at least one damping element has said first end directly connected in an articulated manner to at least one lever of said first four-bar linkage and said second end directly connected in an articulated manner to at least one lever of said second four-bar linkage, wherein said at least one damping element is adapted to assume the extended configuration at the closed configuration and the retracted configuration at the open configuration of said hinge, and wherein said at least one damping element has said first end directly connected in an articulated manner to a tab of the first portion of said first lever that protrudes toward said coupling element at the articulation pivot of said first lever to said coupling element and said second end directly connected in an articulated manner to an extension of said fourth lever that protrudes beyond the articulation pivot of said fourth lever with the second portion of said first lever.

2. The hinge according to claim 1, further comprising first elastic compression means associated with said first four-bar linkage.

3. The hinge according to claim 2, wherein said first elastic means are interposed between said third lever and said coupling element.

4. The hinge according to claim 1, further comprising second elastic compression means associated with said second four-bar linkage.

5. The hinge according to claim 4, wherein said second elastic means are interposed between said fourth lever and said fixing element.

* * * * *